US010933961B1

(12) United States Patent
Lowe

(10) Patent No.: US 10,933,961 B1
(45) Date of Patent: Mar. 2, 2021

(54) DEVICE, SYSTEM AND METHOD FOR DEPLOYING A KAYAK SAIL

(71) Applicant: Warren Lowe, Swiftwater, PA (US)

(72) Inventor: Warren Lowe, Swiftwater, PA (US)

( * ) Notice: Subject to any disclaimer, the term of this patent is extended or adjusted under 35 U.S.C. 154(b) by 0 days.

(21) Appl. No.: 16/745,678

(22) Filed: Jan. 17, 2020

(51) Int. Cl.
*B63H 9/06* (2020.01)
*B63B 15/02* (2006.01)
*B63B 15/00* (2006.01)

(52) U.S. Cl.
CPC ..... *B63H 9/06* (2013.01); *B63B 15/0083* (2013.01); *B63B 15/02* (2013.01)

(58) Field of Classification Search
CPC ..... B63H 9/06; B63B 15/0083; B63B 15/02
See application file for complete search history.

(56) References Cited

U.S. PATENT DOCUMENTS 4,190,980 A * 3/1980 Grycel ..... A63H 23/02 114/144 A
4,388,888 A * 6/1983 Gushurst, Jr. ..... B63H 9/1092 114/90
4,792,700 A * 12/1988 Ammons ..... F03D 13/22 290/55
5,355,817 A * 10/1994 Schrems ..... B63H 9/06 114/153

* cited by examiner

*Primary Examiner* — S. Joseph Morano
*Assistant Examiner* — Jovon E Hayes
(74) *Attorney, Agent, or Firm* — Sean R. Wilsusen, Esq.; Carter, DeLuca & Farrell LLP

(57) ABSTRACT

A kayak sail system includes a sail including a first extending arm, a second extending arm, and a sail sheet supported between the first extending arm and the second extending arm. A deployment body for the sail includes a base plate supporting a first deployment arm and a second deployment arm. The first deployment arm is coupled to the first extending arm of the sail. The second deployment arm is coupled to the second extending arm of the sail. A support arm is spaced apart from the base plate. A first support post and a second support post extend from the support arm. A first extension spring extends from the first deployment arm and a second extension spring extends from the second deployment arm. The first extension spring is removably coupled to the first support post. The second extension spring is removably coupled to the second support post.

20 Claims, 9 Drawing Sheets

DEVICE, SYSTEM AND METHOD FOR DEPLOYING A KAYAK SAIL

BACKGROUND

Technical Field

The present disclosure relates to a device, system and method for deploying a kayak sail, and more particularly, to a device, system and method for deploying a compressible sail.

Background of Related Art

A kayak is a type of watercraft which is typically propelled by means of a double-bladed paddle. Kayak's tend to be relatively small and narrow, while providing seating for a single passenger. Kayak seats may include an in-deck seat or closed deck with a seat positioned atop the deck.

A fishing kayak is a type of kayak that is employed for fishing. Fishing kayaks may be used to access fishing grounds that are relatively distantly spaced apart from a shoreline. Fishing kayaks may also be used to access relatively shallow areas that might not be readily traversed by a traditional fishing boat that is propelled by a motor. Further, fishing kayaks may be used to approach fishing areas in a covert manner by producing a minimum of noise. Additionally, fishing kayaks may be legally deployed on lakes or streams that might not permit use of a boat with a motor.

One potential means of propelling a kayak other than a paddle, is through the use of a sail. However, kayak sails are inherently difficult to deploy and store, and may disrupt kayak stability when wind speeds exceed a predetermined level.

SUMMARY

In accordance with an aspect of the present disclosure, a kayak sail system includes a sail including a first extending arm, a second extending arm, and a sail sheet supported between the first extending arm and the second extending arm. A deployment body for the sail includes a base plate supporting a first deployment arm and a second deployment arm. The first deployment arm is coupled to the first extending arm of the sail. The second deployment arm is coupled to the second extending arm of the sail. A support arm is spaced apart from the base plate. A first support post and a second support post extend from the support arm. A first extension spring extends from the first deployment arm and a second extension spring extends from the second deployment arm. The first extension spring is removably coupled to the first support post. The second extension spring is removably coupled to the second support post.

In some aspects, the base plate includes a first angled sidewall and a second angled sidewall. The first and second angled sidewalls each form an angle greater than ninety degrees with an upper surface of the base plate. A first compression spring is in contact with the first deployment arm and a second compression spring is in contact with the second deployment arm. The first compression spring provides lateral tension to the first deployment arm and the second compression spring provides lateral tension to the second deployment arm. The first deployment arm defines a first compression spring seat that receives a portion of the first compression spring. The second deployment arm defines a second compression spring seat that receives a portion of the second compression spring.

In some aspects, a first guide loop is supported by the first deployment arm. The first guide loop is positioned about a proximal end portion of the first extending arm. A second guide loop is supported by the second deployment arm. The second guide loop is positioned about a proximal end portion of the second extending arm.

In some aspects, an attachment block is secured to the kayak. The deployment body is detachably coupled to the attachment block. A quick release mechanism secures the deployment body to the attachment block. The attachment block defines a channel. The deployment body includes a first side support bar, a second side support bar, and a projection engaged in the channel defined by the attachment block.

In some aspects, a first attachment loop is coupled to a distal end portion of the first extending arm of the sail. A second attachment loop is coupled to a portion of the first extending arm of the sail proximal to the distal end portion of the first extending arm of the sail. A third attachment loop is coupled to a distal end portion of the second extending arm of the sail. A fourth attachment loop is coupled to a portion of the second extending arm of the sail proximal to the distal end portion of the second extending arm. A first tether line connects the first and second attachment loops. A second tether line connects the third and fourth attachment loops.

In some aspects, the deployment body includes a first kayak attachment loop, a second kayak attachment loop, a third kayak attachment loop, and a fourth kayak attachment loop. The first and second kayak attachment loops secure the first tether line to the kayak and the third and fourth kayak attachment loops secure the second tether line to the kayak. The first tether line bends a length of the first extending arm of the sail between the first and second attachment loops. The second tether line bends a length of the second extending arm of the sail between the third and fourth attachment loops.

In some aspects, the deployment body includes a first cam cleat secured to first side of the kayak and a second cam cleat secured to a second side of the kayak. The first cam cleat secures the first tether line. The second cam cleat secures the second tether line.

In some aspects, the deployment body includes a fifth kayak attachment loop secured between the second and fourth kayak attachment loops. The first tether line and the second tether line are connected with each other as a single continuous tether line.

In some aspects, the sail folds substantially along a vertical centerline thereof. The first and second extending arms of the sail retract against a side of the kayak.

In some aspects, the sail includes a transparent window between the first and second extending arms.

In some aspects, the first extending arm and the second extending arm each define a tapered configuration.

In accordance with an aspect of the present disclosure, a kayak sail deployment body includes a base plate supporting a first deployment arm and a second deployment arm. A support arm is spaced apart from the base plate. A first support post and a second support post extend from the support arm. A first extension spring extends from the first deployment arm. A second extension spring extends from the second deployment arm. The first extension spring is removably coupled to the first support post. The second extension spring is removably coupled to the second support post. A first compression spring is in contact with the first deployment arm and a second compression spring in contact with the second deployment arm. The first compression spring provides lateral tension to the first deployment arm. The second compression spring provides lateral tension to the second deployment arm.

BRIEF DESCRIPTION OF THE DRAWINGS

The accompanying drawings, which are incorporated in and constitute a part of this specification, illustrate embodiments of the present disclosure and, together with the detailed description below, serve to further explain the present disclosure, in which.

DETAILED DESCRIPTION

Figure 1A:
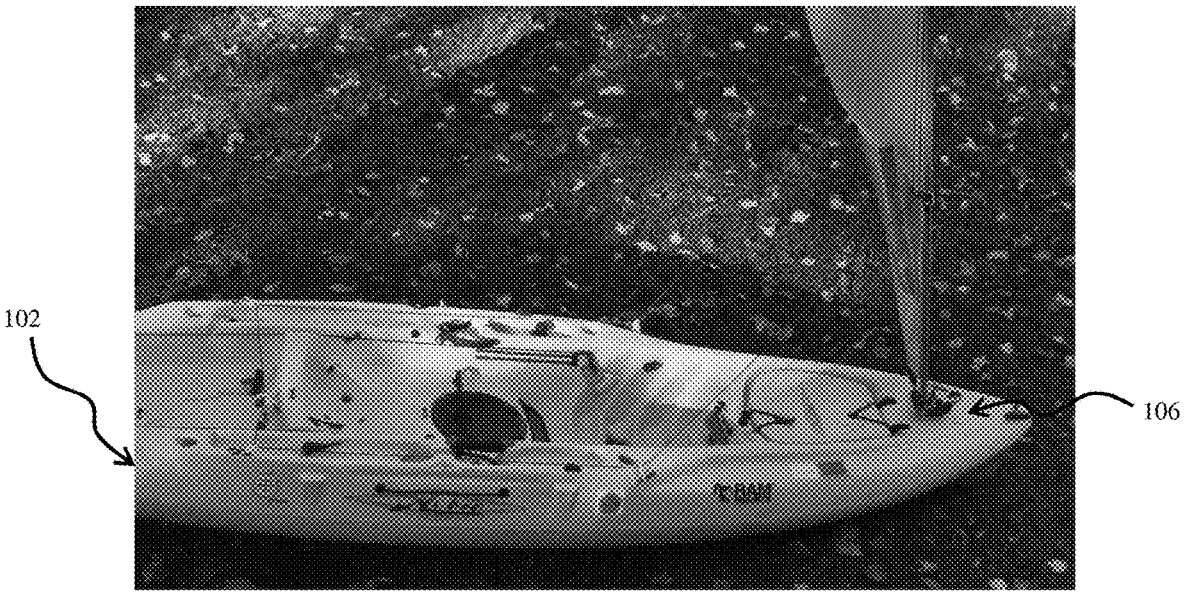
FIG. 1A is a side view of a kayak sail system according to an exemplary embodiment of the present disclosure.

Exemplary embodiments of the present disclosure will be described more fully below (e.g., with reference to the accompanying drawings). Like reference numerals may refer to like elements throughout the specification and drawings.

It will be understood that the terms "first," "second," "third," etc. are used herein to distinguish one element from another, and the elements are not limited by these terms. Thus, a "first" element in an exemplary embodiment may be described as a "second" element in another exemplary embodiment.

As used herein, the term "distal" refers to the portion that is being described which is further from a user, while the term "proximal" refers to the portion that is being described which is closer to a user. Further, to the extent consistent, any of the aspects and features detailed herein may be used in conjunction with any or all of the other aspects and features detailed herein.

As used herein, the terms parallel and perpendicular are understood to include relative configurations that are substantially parallel and substantially perpendicular up to about + or −10 degrees from true parallel and true perpendicular.

Exemplary axes or directions such as an X-axis direction, a Y-axis direction and a Z-axis direction may be illustrated in the accompanying drawings and/or described herein. As an example, the X-axis direction may perpendicular to the Y-axis direction, and the Z-axis direction may be orthogonal to the X-axis direction and the Y-axis direction.

"About" or "approximately" or "substantially" as used herein may be inclusive of the stated value and means within an acceptable range of variation for the particular value as determined by one of ordinary skill in the art, considering the measurement in question and the error associated with measurement of the particular quantity (e.g., the limitations of the measurement system). For example, "about" may mean within one or more standard variations, or within ±30%, 20%, 10%, 5% of the stated value.

Descriptions of technical features or aspects of an exemplary embodiment of the present disclosure should typically be considered as available and applicable to other similar features or aspects in another exemplary embodiment of the present disclosure. Accordingly, technical features described herein according to one exemplary embodiment of the present disclosure may be applicable to other exemplary embodiments of the present disclosure, and thus duplicative descriptions may be omitted herein.

Figure 1B:
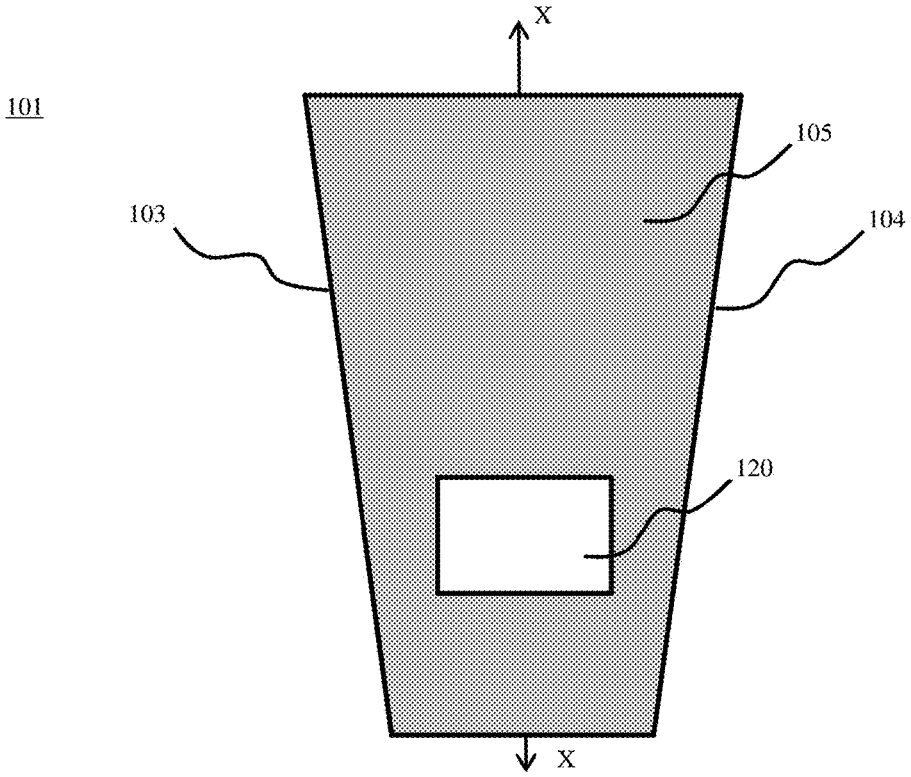
FIG. 1B is a conceptual diagram of a sail of the kayak sail system according to an exemplary embodiment of the present disclosure.
Figure 2:
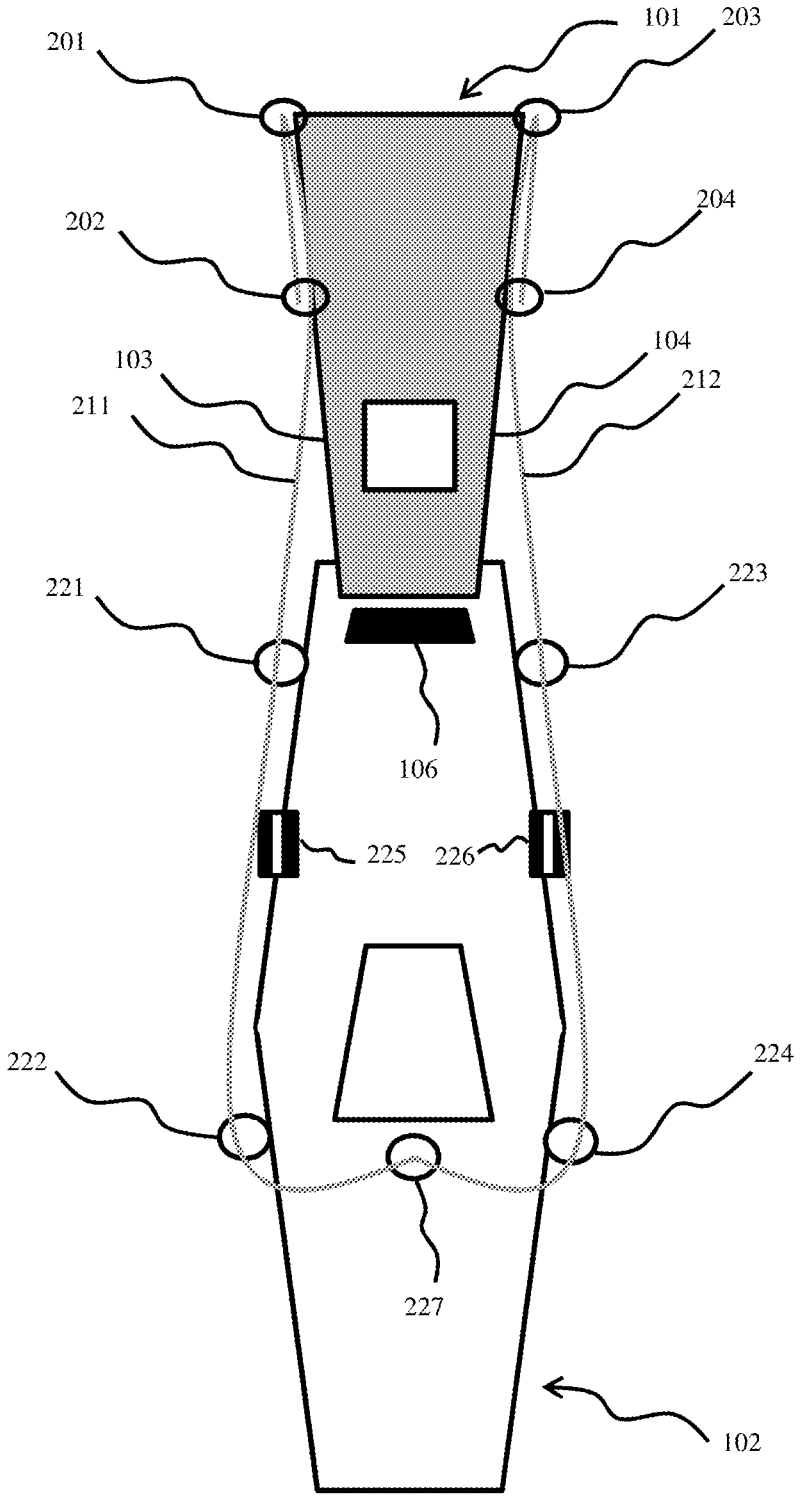
FIG. 2 is a conceptual diagram of a tether arrangement of the kayak sail system according to an exemplary embodiment of the present disclosure.
Figure 3A:
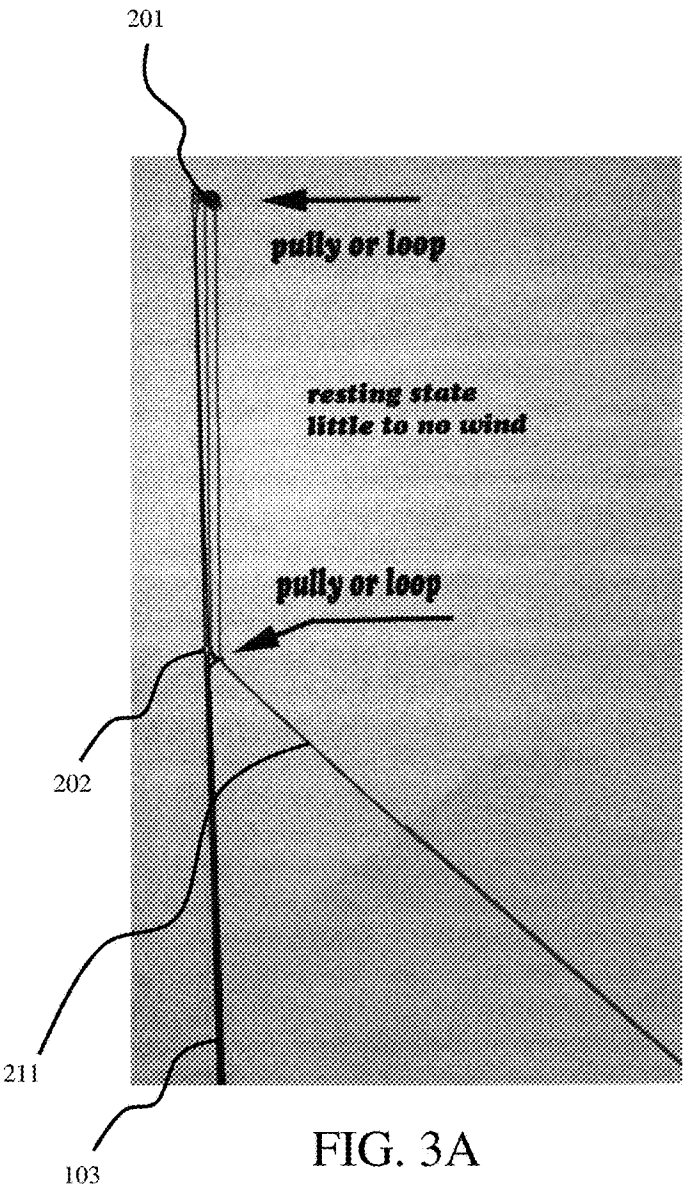
FIG. 3A illustrates an extending arm in an unbent state with a tether attached to the extending arm.
Figure 3B:
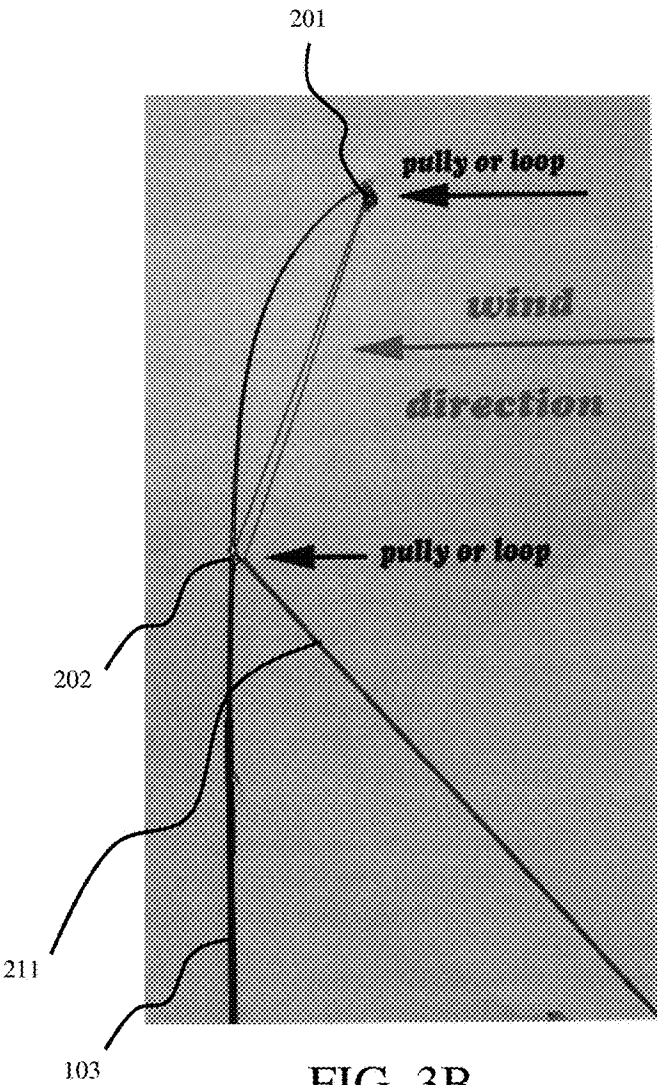
FIG. 3B illustrates the extending arm of FIG. 3A in a bent configuration.
Figure 4:
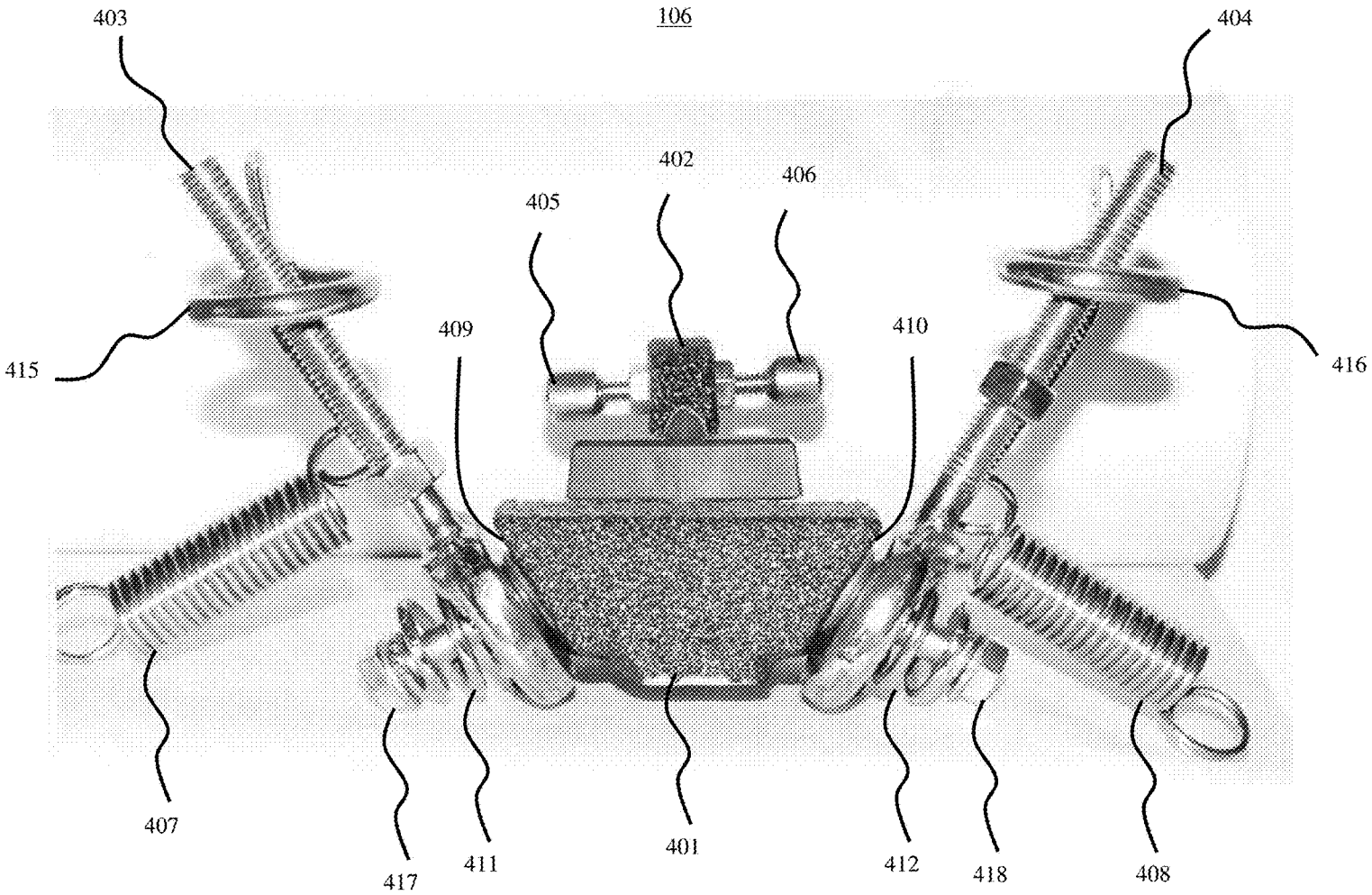
FIG. 4 is a rear view of a deployment body of the kayak sail system according to an exemplary embodiment of the present disclosure.
Figure 5:
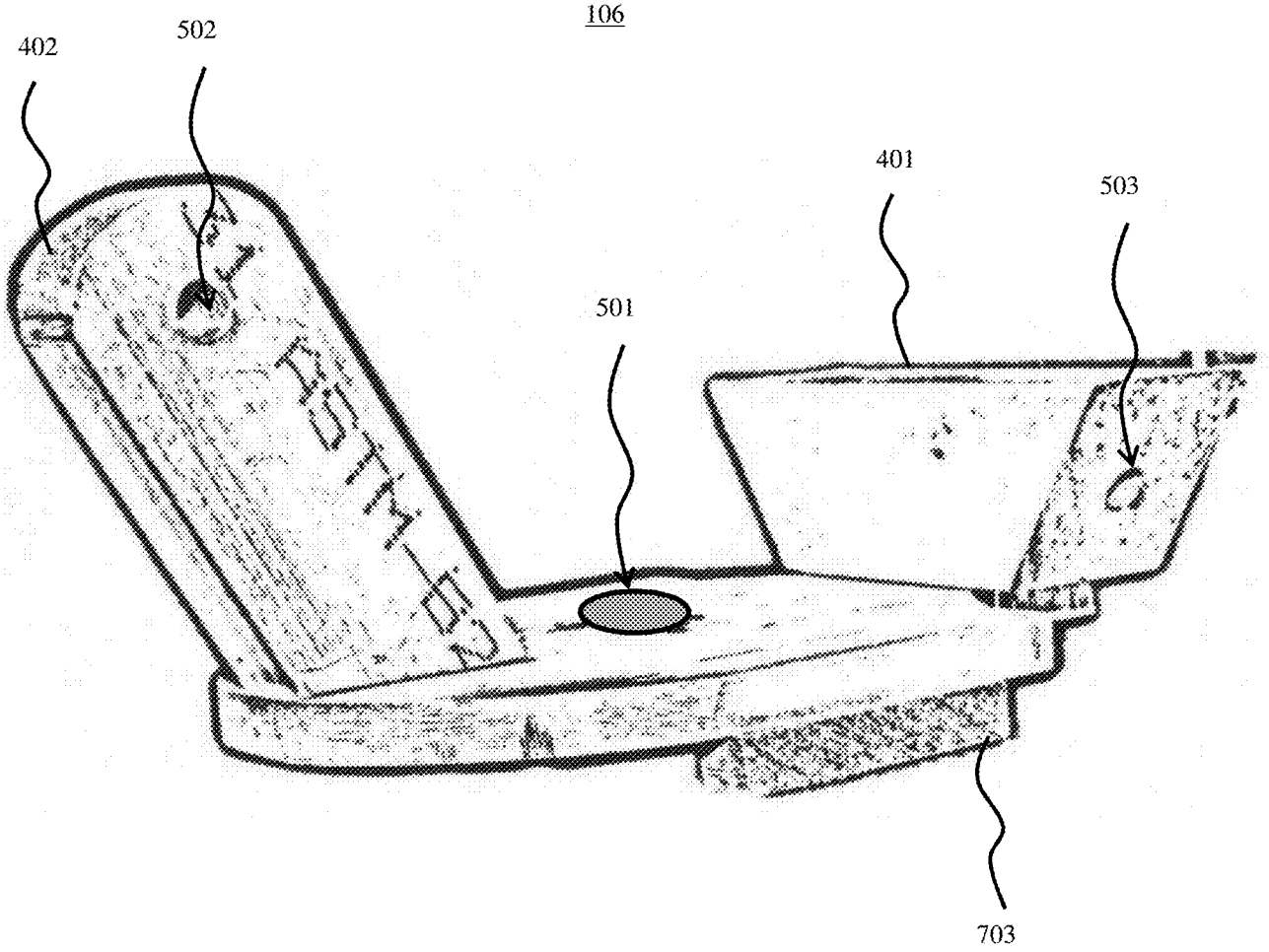
FIG. 5 is a side view of the deployment body of FIG. 4.
Figure 6:
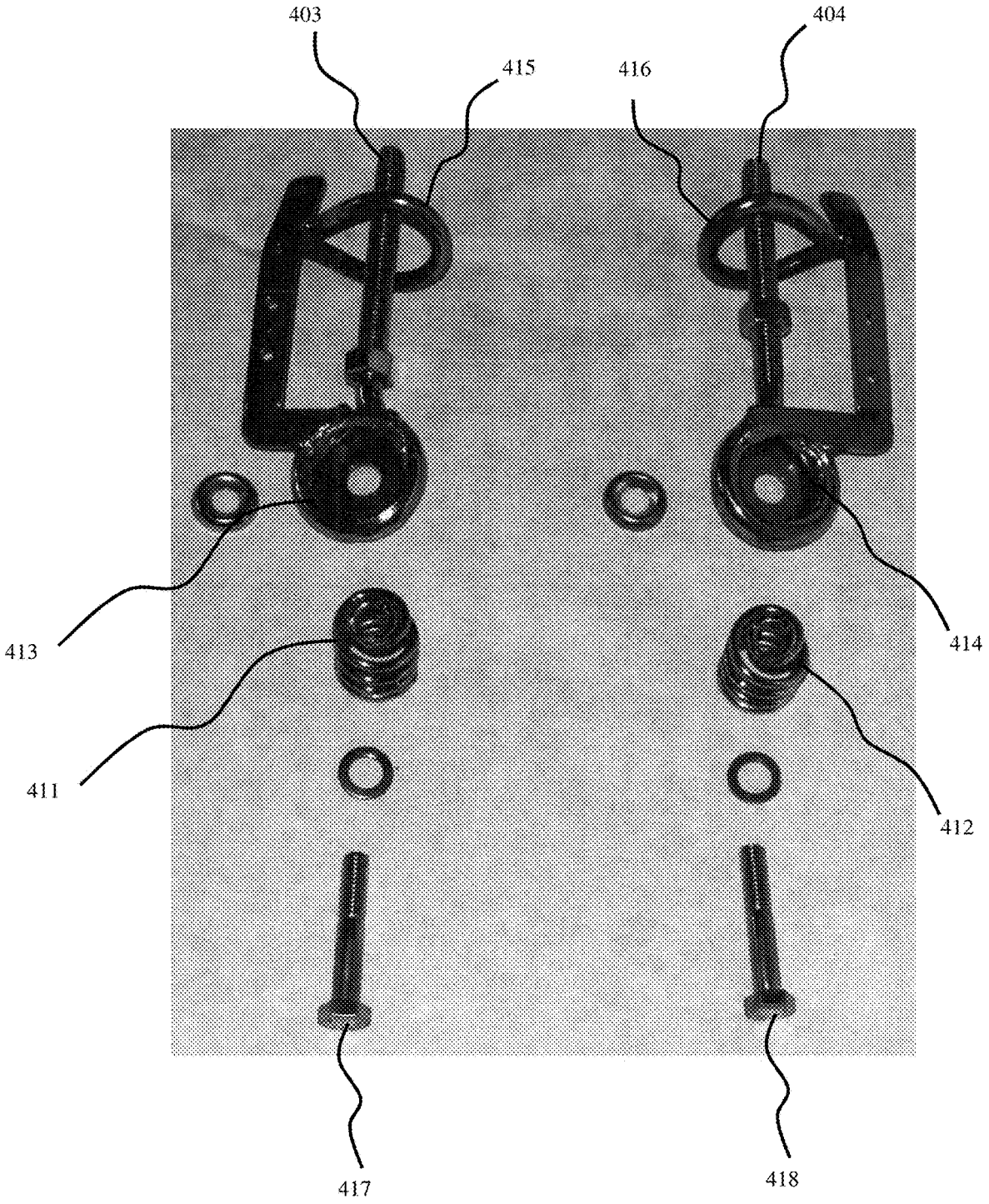
FIG. 6 illustrates first and second deployment arms of the kayak sail system in a disassembled stated.
Figure 7A:
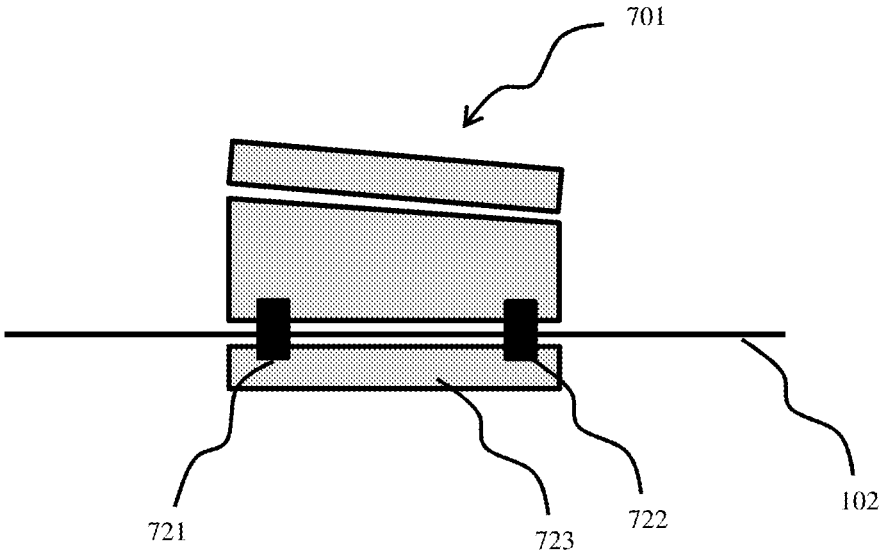
FIG. 7A is a side view of an attachment block of the kayak sail system according to an exemplary embodiment of the present disclosure.
Figure 7B:
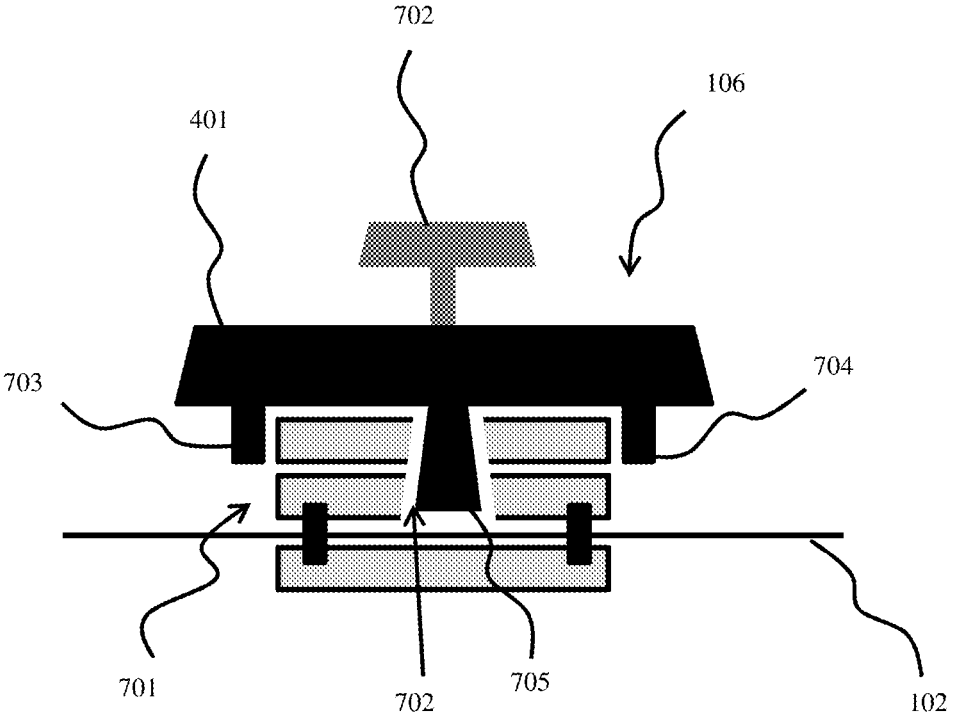
FIG. 7B is a rear view of the attachment block of FIG. 7A.
Figure 8:
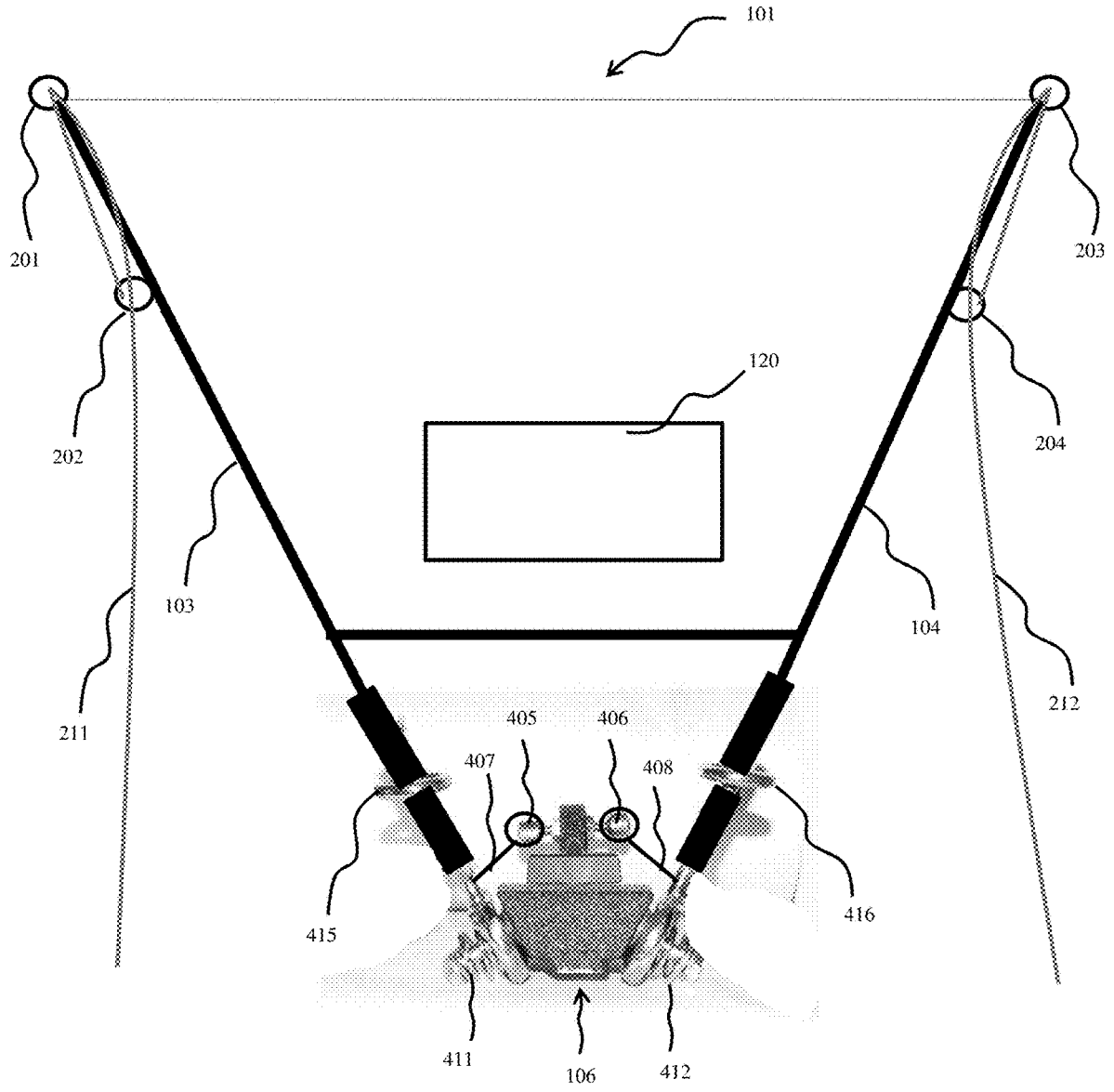
FIG. 8 illustrates first and second extending arms respectively connected with the first and second deployment arms of the base plate of the kayak sail system according to an exemplary embodiment of the present disclosure.
Figure 9:
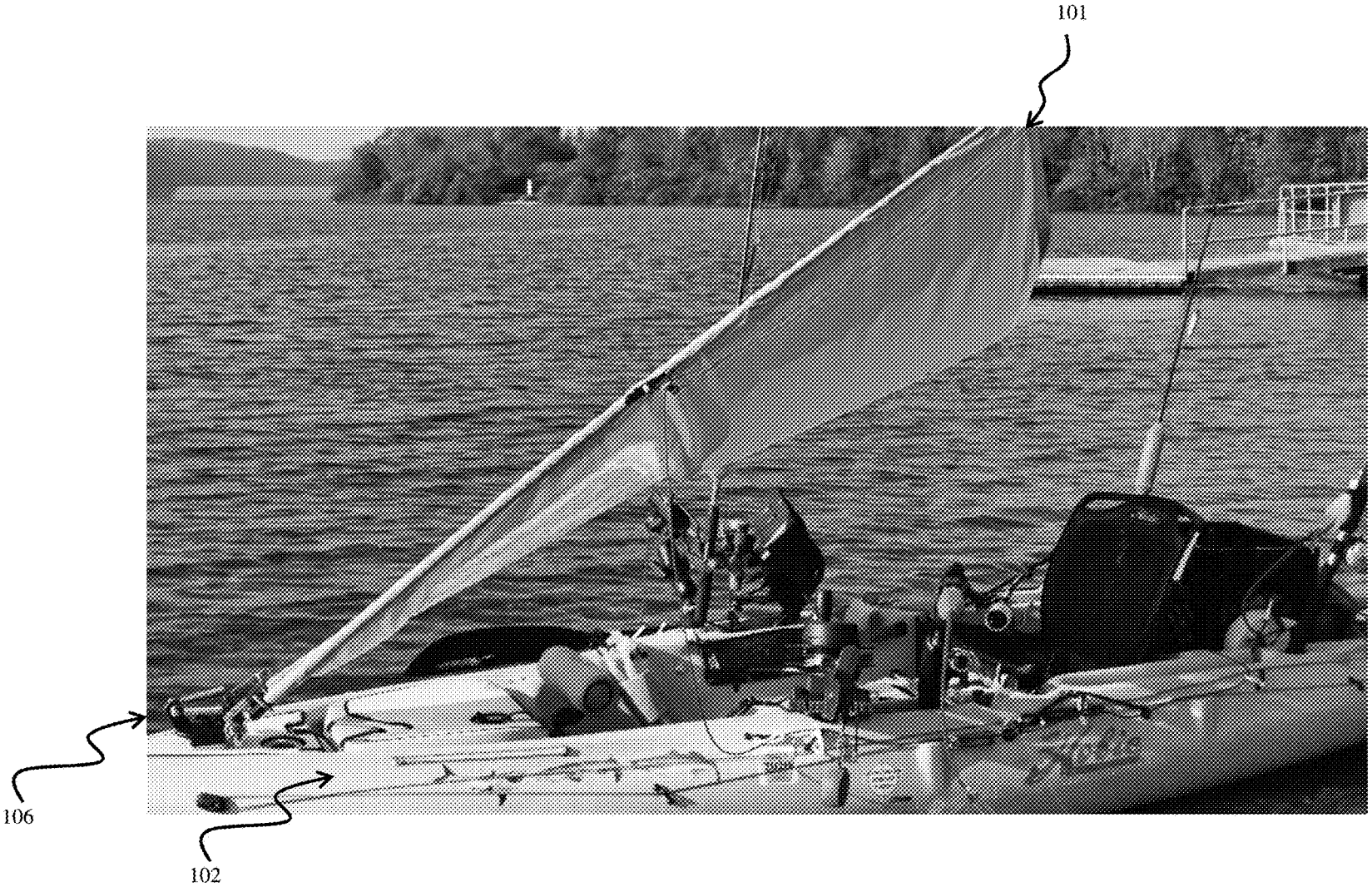
FIG. 9 is a side view of the sail deployed by the kayak sail system according to an exemplary embodiment of the present disclosure.

FIG. 1A is a side view of a kayak sail system according to an exemplary embodiment of the present disclosure. FIG. 1B is a conceptual diagram of a sail of the kayak sail system according to an exemplary embodiment of the present disclosure. FIG. 2 is a conceptual diagram of a tether arrangement of the kayak sail system according to an exemplary embodiment of the present disclosure. FIG. 3A illustrates an extending arm in an unbent state with a tether attached to the extending arm. FIG. 3B illustrates the extending arm of FIG. 3A in a bent configuration. FIG. 4 is a rear view of a deployment body of the kayak sail system according to an exemplary embodiment of the present disclosure. FIG. 5 is a side view of the deployment body of FIG. 4. FIG. 6 illustrates first and second deployment arms of the kayak sail system in a disassembled stated. FIG. 7A is a side view of an attachment block of the kayak sail system according to an exemplary embodiment of the present disclosure. FIG. 7B is a rear view of the attachment block of FIG. 7A. FIG. 8 illustrates first and second extending arms respectively connected with the first and second deployment arms of the base plate of the kayak sail system according to an exemplary embodiment of the present disclosure. FIG. 9 is a side view of the sail deployed by the kayak sail system according to an exemplary embodiment of the present disclosure.

Referring to FIGS. 1A-9, a kayak sail system is described. The kayak sail system described herein may be built into a kayak at the time of manufacturing the kayak, or a previously manufactured kayak may be retrofitted to utilize the kayak sail system described herein.

A kayak sail system according to an exemplary embodiment of the present disclosure includes a sail 101 including a first extending arm 103, a second extending arm 104, and a sail sheet 105 supported between the first extending arm 103 and the second extending arm 104. A deployment body 106 for the sail 101 includes a base plate 401 supporting a first deployment arm 403 and a second deployment arm 404. The first deployment arm 403 is coupled to the first extending arm 103 of the sail 101. The second deployment arm 404 is coupled to the second extending arm 104 of the sail 101 (see, e.g., FIG. 8). A support arm 402 is spaced apart from the base plate 401. A first support post 405 and a second support post 406 extend from the support arm 402. A first extension spring 407 extends from the first deployment arm 403 and a second extension spring 408 extends from the second deployment arm 404. The first extension spring 407 is removably coupled to the first support post 405 and he second extension spring 408 is removably coupled to the second support post 406 (when the sail 101 is in a deployed state—see, e.g., FIGS. 1, 8 and 9).

Support posts 405 and 406 may each include threaded ends rotatably secured to threaded bores (see, e.g., 502 in FIG. 5) formed in support arm 402.

According to an exemplary embodiment, the base plate 401 includes a first angled sidewall 409 and a second angled sidewall 410. The angled sidewalls 409 and 410 create surfaces against which the first deployment arm 403 and the second deployment arm 404 can rotate to deploy the sail 101 in a "V" shape.

The first and second angled sidewalls 409 and 410 each form an angle greater than ninety degrees with an upper surface of the base plate 401. A first compression spring 411 is in contact with the first deployment arm 403 and a second compression spring 412 is in contact with the second deployment arm 404. The first compression spring 411 provides lateral tension to the first deployment arm 403 and the second compression spring 412 provides lateral tension to the second deployment arm 404. The first compression spring 411 may be secured to the base plate 401 by a first securing bolt 417 and the second compression spring 412 may be secured to the base plate 401 by a second securing bolt 418. The first and second securing bolts 417 and 418 may each project through a center opening of the first compression spring 411 or the second compression spring 412, respectively. This allows the first deployment arm 403 and the second deployment arm 404 to tilt laterally to form different angles with respect to the base plate 401. Additionally, this lateral movement allows the sail 101 to laterally collapse if a strong wind is encountered, which eliminates the possibility of the kayak 102 flipping over. The first deployment arm 403 and the second deployment arm 404 are respectively designed to rotate about the first and second securing bolts 417 and 418. This allows the sail 101 to be folded against a side of the kayak 102 when not in use, and also allows the sail 101 to be deployed, when desired.

Securing bolts 417 and 418 may each include threaded ends rotatably secured to threaded bores (see, e.g., 503 in FIG. 5) formed in base plate 401.

Washers or other spacers may be positioned between rotatable components described herein and a fixed component described herein (e.g., between deployment arms 403 and 404 and the base plate 401). This allows a reduction in friction and prevents deterioration of moveable parts described herein.

The first deployment arm 403 may define a first compression spring seat 413 that receives a portion of the first compression spring 411. The second deployment arm 404 defines a second compression spring seat 414 that receives a portion of the second compression spring 412. Washers may be positioned at opposite sides of each of the first and second compression springs 411 and 412.

According to an exemplary embodiment, a first guide loop 415 is supported by the first deployment arm 403. The first guide loop 415 is positioned about a proximal end portion of the first extending arm 103 and about the first deployment arm 403. A second guide loop 416 is supported by the second deployment arm 404. The second guide loop 416 is positioned about a proximal end portion of the second extending arm 104 and about the second deployment arm 404 (see, e.g., FIGS. 4 and 8). The guide loops 415 and 416 create increased stability at an attachment points between the deployment arms 403 and 404 and the extending arms 103 and 104.

According to an exemplary embodiment, an attachment block 701 is secured to the kayak 102. The attachment block 701 may be secured to the kayak 102 at a time of manufacturing the kayak 102 or kayak 102 may be retrofitted such that attachment block 701 is secured thereto in order to add the kayak sail system described herein. The deployment body 106 is detachably coupled to the attachment block 701. A quick release mechanism 702 secures the deployment body 106 to the attachment block 701. The quick release mechanism 702 may include a threaded end configured to be twisted through threaded bore 501 into a threaded bore of the attachment block 701 (see, e.g., FIG. 7B).

According to an exemplary embodiment, the attachment block 701 defines a channel 702 open at a rear facing surface thereof. The deployment body 106 includes a first side support bar 703, a second side support bar 704, and a projection 705 engaged in the channel 702 defined by the attachment block 701. The shape of the projection 705 may correspond with the shape of the channel 702, which may prevent vertical and/or lateral movement of the deployment body 106.

The attachment block 701 may be secured to an upper surface of the kayak 102 by a plurality of attachment bolts (e.g., 721 and 722 in FIGS. 7A and 7B). The attachment bolts may connect with a support plate 723 positioned below the upper surface of the kayak 102. Thus, the support plate 723 might not be visible from an exterior of the kayak 102. The attachment block 701 may include first block having an angled upper surface and a second block disposed on the first block. The angled upper surface may position the deployment body 106 at a desired angle with respect to the upper surface of the kayak 102.

According to an exemplary embodiment, a first attachment loop 201 is coupled to a distal end portion of the first extending arm 103 of the sail 101. A second attachment loop 202 is coupled to a portion of the first extending arm 103 of the sail 101 proximal to the distal end portion of the first extending arm 103 of the sail 101. A third attachment loop 203 is coupled to a distal end portion of the second extending arm 104 of the sail 101. A fourth attachment loop 204 is coupled to a portion of the second extending arm 104 of the sail 101 proximal to the distal end portion of the second extending arm 104. A first tether line 211 connects the first and second attachment loops 201 and 202. A second tether line 212 connects the third and fourth attachment loops 203 and 204.

According to an exemplary embodiment, the kayak 102 may be outfitted to include a first kayak attachment loop 221, a second kayak attachment loop 222, a third kayak attachment loop 223, and a fourth kayak attachment loop 224. The first and second kayak attachment loops 221 and 222 secure the first tether line 211 to the kayak 102 and the third and fourth kayak attachment loops 223 and 224 secure the second tether line 212 to the kayak 102. The first tether line 211 bends a length of the first extending arm 103 of the sail 101 between the first and second attachment loops 201 and 202. The second tether line 212 bends a length of the second extending arm 104 of the sail 101 between the third and fourth attachment loops 203 and 204.

According to an exemplary embodiment, the kayak 102 includes a first cam cleat 225 secured to first side of the kayak 102 and a second cam cleat 226 secured to a second side of the kayak 102. The first cam cleat 225 releasably secures the first tether line 211. The second cam cleat 226 releasably secures the second tether line 212. As an example, cam cleats 225 and 226 may employ two spring-loaded cams configured to releasably pinch a rope (e.g., tether lines 211 or 212) therebetween. In use, one or both tether lines 211 and/or 212 may be pulled toward a user of the kayak 102 such that the sail 101 may be curved toward the user to better catch the wind. This allows the position and orientation of the sail 101 to be adjusted in order to achieve a desired operating speed. As an example, the desired operating (sailing) speed of the kayak 102 may be at a desired fishing lure trolling speed (e.g., from about 2 mph to about 6 mph).

FIG. 9, for example, illustrates the sail 101 of the kayak 102 bent at one side. FIG. 9 also demonstrates how the sail 101 can be bent toward a side of the kayak 102 by pulling on and/or releasing one or both tether lines 211 and/or 212.

According to an exemplary embodiment, the kayak 102 includes a fifth kayak attachment loop 227 secured between the second and fourth kayak attachment loops 222 and 224 (e.g., behind a seat of the kayak 102). The first tether line and the second tether line 211 and 212 may be connected with each other as a single continuous tether line (see, e.g., FIG. 2).

According to an exemplary embodiment, the sail 101 folds substantially along a vertical centerline (e.g., line X-X in FIG. 1B) thereof. The first and second extending arms 103 and 104 of the sail 101 retract against a side of the kayak 102. A securing strap may be positioned about the first and/or second extending arms 103 and/or 104 of the sail 101 to allow the sail 101 to be wrapped up for storage or when not deployed.

In use, when the first and second extending arms 103 and 104 of the sail 101 are released from a side of the kayak 102 from a stowed position, the extension springs 407 and 408 may apply tension to deployment arms 403 and 404 to rotate the deployment arms 403 and 404 from a stowed position extending along a length of the kayak 102 to a deployed position in which the deployment arms 403 and 404 face in a substantially upward direction (see, e.g., FIG. 8 illustrating an exemplary deployed arrangement of the sail 101 having a "V" shape).

According to an exemplary embodiment, the sail 101 includes a transparent window 120 between the first extending arm 103 and the second extending arm 104. Alternatively, substantially the entire sail 101 may be transparent. This allows a user to see through the sail 101 during operation of the kayak 102.

According to an exemplary embodiment, the first extending arm 103 and the second extending arm 104 each define a tapered configuration (see, e.g., FIGS. 3A and 3B). For example, the first extending arm 103 and the second extending arm 104 each become gradually narrower from proximal ends to distal ends thereof. This allows for increased strength and rigidity at bases of the first extending arm 103 and the second extending arm 104, while also allowing bending and flexibility at distal end portions thereof to allow desired sail shape/angle adjustment to achieve desired kayak 102 speeds across water.

The disclosures of each of the references, patents and published patent applications disclosed herein are each incorporated by reference herein in their entireties.

From the foregoing and with reference to the various figure drawings, those skilled in the art will appreciate that certain modifications can also be made to the present disclosure without departing from the scope of the same. While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A kayak sail system, comprising:

a sail including a first extending arm, a second extending arm, and a sail sheet supported between the first extending arm and the second extending arm; and a deployment body for the sail, the deployment body including:

a base plate supporting a first deployment arm and a second deployment arm, the first deployment arm coupled to the first extending arm of the sail and the second deployment arm coupled to the second extending arm of the sail;

a support arm spaced apart from the base plate, a first support post and a second support post extending from the support arm; and a first extension spring extending from the first deployment arm and a second extension spring extending from the second deployment arm, wherein the first extension spring is configured to be removably coupled to the first support post, and wherein the second extension spring is configured to be removably coupled to the second support post.

2. The kayak sail system of claim 1, wherein the base plate includes a first angled sidewall and a second angled sidewall, wherein the first and second angled sidewalls each form an angle greater than ninety degrees with an upper surface of the base plate.

3. The kayak sail system of claim 2, further including a first compression spring in contact with the first deployment arm and a second compression spring in contact with the second deployment arm, the first compression spring configured to provide lateral tension to the first deployment arm and the second compression spring configured to provide lateral tension to the second deployment arm.

4. The kayak sail system of claim 3, wherein the first deployment arm defines a first compression spring seat configured to receive a portion of the first compression spring, and wherein the second deployment arm defines a second compression spring seat configured to receive a portion of the second compression spring.

5. The kayak sail system of claim 1, further including a first guide loop supported by the first deployment arm, the first guide loop positioned about a proximal end portion of the first extending arm, and a second guide loop supported by the second deployment arm, the second guide loop positioned about a proximal end portion of the second extending arm.

6. The kayak sail system of claim 1, further including an attachment block secured to the kayak, wherein the deployment body is configured to be detachably coupled to the attachment block.

7. The kayak sail system of claim 6, further including a quick release mechanism configured to secure the deployment body to the attachment block.

8. The kayak sail system of claim 7, wherein the attachment block defines a channel, wherein the deployment body includes a first side support bar, a second side support bar, and a projection configured to be engaged in the channel defined by the attachment block.

9. The kayak sail system of claim 1, further including a first attachment loop coupled to a distal end portion of the first extending arm of the sail, a second attachment loop coupled to a portion of the first extending arm of the sail proximal to the distal end portion of the first extending arm of the sail, a third attachment loop coupled to a distal end portion of the second extending arm of the sail, and a fourth attachment loop coupled to a portion of the second extending arm of the sail proximal to the distal end portion of the second extending arm, wherein a first tether line connects the first and second attachment loops, and a second tether line connects the third and fourth attachment loops.

10. The kayak sail system of claim 9, further including a first kayak attachment loop and a second kayak attachment loop, a third kayak attachment loop and a fourth kayak attachment loop, the first and second kayak attachment loops configured to secure the first tether line to the kayak and the third and fourth kayak attachment loops configured to secure the second tether line to the kayak, wherein the first tether line is configured to bend a length of the first extending arm of the sail between the first and second attachment loops, and wherein the second tether line is configured to bend a length of the second extending arm of the sail between the third and fourth attachment loops.

11. The kayak sail system of claim 10, further including a first cam cleat configured to be secured to first side of the kayak and a second cam cleat configured to be secured to a second side of the kayak, the first cam cleat configured to secure the first tether line, and the second cam cleat configured to secure the second tether line.

12. The kayak sail system of claim 11, further including a fifth kayak attachment loop configured to be secured between the second and fourth kayak attachment loops, wherein the first tether line and the second tether line are connected with each other as a single continuous tether line.

13. The kayak sail system of claim 1, wherein the sail is configured to fold substantially along a vertical centerline thereof, and wherein the first and second extending arms of the sail are configured to be retracted against a side of the kayak.

14. The kayak sail system of claim 1, wherein the sail includes a transparent window between the first and second extending arms.

15. The kayak sail system of claim 1, wherein the first extending arm and the second extending arm each define a tapered configuration.

16. A kayak sail deployment body, comprising:

a base plate supporting a first deployment arm and a second deployment arm;

a support arm spaced apart from the base plate, a first support post and a second support post extending from the support arm;

a first extension spring extending from the first deployment arm and a second extension spring extending from the second deployment arm, wherein the first extension spring is configured to be removably coupled to the first support post, and wherein the second extension spring is configured to be removably coupled to the second support post; and a first compression spring in contact with the first deployment arm and a second compression spring in contact with the second deployment arm, the first compression spring configured to provide lateral tension to the first deployment arm and the second compression spring configured to provide lateral tension to the second deployment arm.

17. The kayak sail deployment body of claim 16, wherein the base plate includes a first angled sidewall and a second angled sidewall, wherein the first and second angled sidewalls each form an angle greater than ninety degrees with an upper surface of the base plate.

18. The kayak sail deployment body of claim 16, wherein the first deployment arm defines a first compression spring seat configured to receive a portion of the first compression spring, and wherein the second deployment arm defines a second compression spring seat configured to receive a portion of the second compression spring.

19. The kayak sail deployment body of claim 16, further including a first guide loop supported by the first deployment arm and a second guide loop supported by the second deployment arm.

20. The kayak sail deployment body of claim 16, further including a threaded bore configured to receive a quick release mechanism, the quick release mechanism configured to secure the kayak sail deployment body to a kayak.

* * * * *